United States Patent [19]

Rademacher

[11] Patent Number: 4,896,713

[45] Date of Patent: Jan. 30, 1990

[54] DRIVE UNIT FOR A VERTICAL BLIND OR THE LIKE AND VERTICAL BLIND UTILIZING SAME

[76] Inventor: Wilhelm Rademacher, Buschkamp 7, 4292 Rhede, Fed. Rep. of Germany

[21] Appl. No.: 206,320

[22] Filed: Jun. 14, 1988

[30] Foreign Application Priority Data

Jul. 9, 1987 [DE] Fed. Rep. of Germany ..... 3722631
May 5, 1988 [EP] European Pat. Off. ..... 88107197.1

[51] Int. Cl.[4] ..... E06B 9/30
[52] U.S. Cl. ..... 160/168.1; 160/321
[58] Field of Search ..... 160/168.1, 321, 331, 160/310, 311, DIG. 17

[56] References Cited

U.S. PATENT DOCUMENTS

| | | | |
|---|---|---|---|
| 2,029,143 | 1/1936 | Wicks . | |
| 2,788,481 | 4/1957 | Lui et al. | 160/331 X |
| 4,031,944 | 6/1977 | Morrison et al. | 160/331 |
| 4,350,197 | 9/1982 | Haller | 160/900 X |
| 4,621,673 | 11/1986 | Georgopoulos et al. | 160/168.1 |
| 4,712,104 | 12/1987 | Kobayashi | 160/DIG. 17 X |

*Primary Examiner*—Blair M. Johnson

*Attorney, Agent, or Firm*—Sixbey, Friedman, Leedom & Ferguson

[57] ABSTRACT

Drive unit for a vertical blind or the like, where the slats of the vertial blinds can be moved by an endless pull element, such as a pull chain. The drive unit has a housing (5) formed, for example, of plastic, an electric drive motor (6) placed in the housing (5), and a drive pinion or the like coupled to the drive motor, optionally by an inserted reduction gear. By enclosing of the drive components within the housing, a safe and unobtrusive drive unit is created. Preferred embodiments of the unit are constructed to enable the pull element to enter the housing through openings therein and be hung on the drive pinion. By this construction and the provision of control switches on the housing for operation of the electric drive motor, the drive unit is inexpensive and able to be retrofitted simply and versatily. Additionally, in an emergency, easy hand operation of the vertical blinds is still possible. Still further, the drive unit is designed to enable mounting of it in each of two positions that are displaced 180° relative to each other by the provision of openings for the pull element at each of opposite sides of the housing and by enabling the mounting position of the switch controls to be inverted relative to the remainder of the housing.

21 Claims, 5 Drawing Sheets

Fig. 2
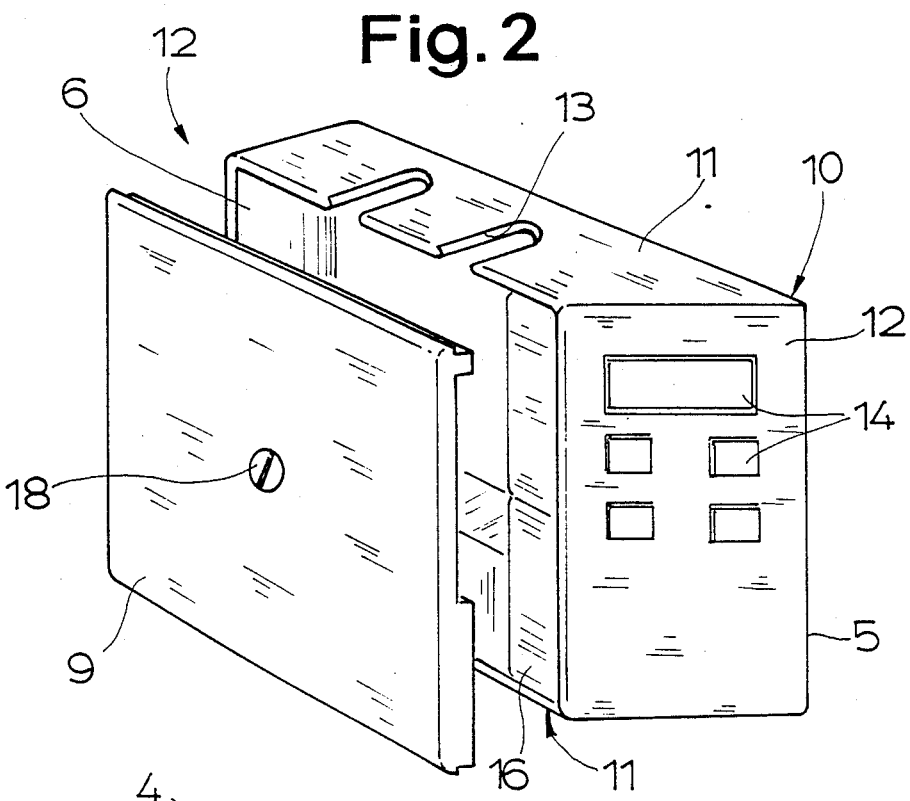
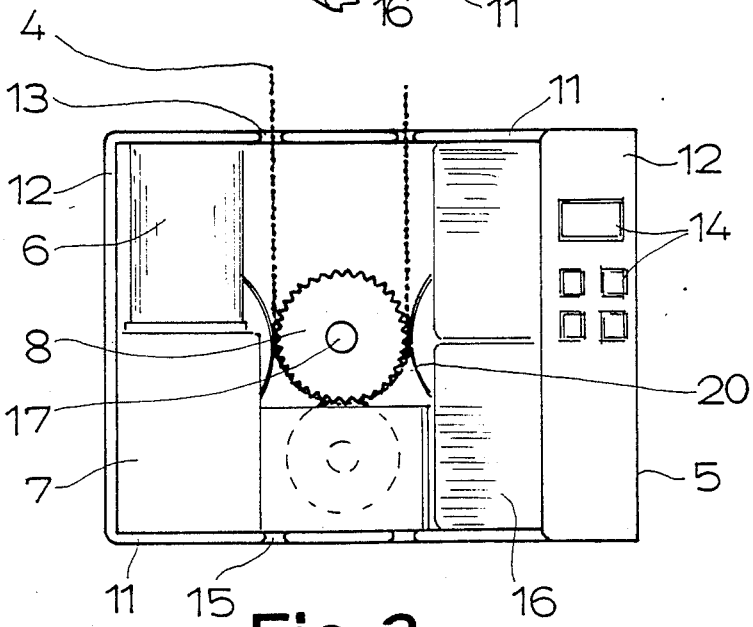
Fig. 3

DRIVE UNIT FOR A VERTICAL BLIND OR THE LIKE AND VERTICAL BLIND UTILIZING SAME

BACKGROUND OF THE INVENTION

The invention relates to a drive unit for a vertical blind or the like wherein vertically oriented slats are movable by a pull element, such as a pull chain or cord, and an electric drive motor is provided for operation of the pull element. The invention also relates to a vertical blind equipped with such a drive unit.

Vertical blinds consisting of a multiplicity of lamellar, rigid slats hanging vertically next to each other and which can be pulled along an upper support guide rail as well as pivoted around a vertical axis, are being used increasingly, especially in the commercial sphere, i.e., for office spaces, etc. The slats of such vertical blinds are typically moved by a pull element that runs in the upper support guide rail, namely, with modern, convenient, easy to use vertical blinds, the slats are pulled and pivoted by a pull element in the form of a single pull chain or cord. Often, this kind of pull element is a traction rope with catch beads knotted in or otherwise attached. Instead of a pull chain, other pull elements, for example, a wire rope encased in plastic or the like, are also known. Similar operating relationships as those used in vertical blinds also are found in some normal curtains and other decorations that are to be pulled.

In vertical blinds operated by hand, the pull element, in particular the pull chain or cord, hangs down from the support guide rail on one end of the vertical blinds, far enough so that an operator can pull the pull chain or cord by hand. Normally, in doing so the pull chain or cord moves in an endless circuit. In more convenient vertical blinds, an electromotive drive unit is provided that is put directly on the support guide rail, at one end of the vertical blind. An associated switch control, usually a simple ON/OFF stop switch, is placed at a separate location from the housing of the drive unit, for example, at an appropriate place on the nearest wall or the like. The switch control is normally connected to the electric drive motor in the housing of the drive unit by a cable that is, generally, laid under plaster.

The problem with the known drive unit, described above, centers on the fact that it is not especially easy to retrofit it on existing hand-operated vertical blinds. To retrofit it, the pull element, in particular the pull chain or cord, must first be shortened and then rejoined so that it is tensioned with an accurate fit around the drive pinion in the housing of the drive unit placed on the guide rail. A box for the switch control must be put on the nearest wall and connected by junction cable to the housing of the drive unit. Even if, with greater engineering expense, a wireless connection between the switch control and the electric drive motor of the drive unit is considered, retrofitting is still not especially simple and is expensive in any case.

In addition, with the previously explained known drive unit for vertical blinds, hand operation, if possible, is achieved only with difficulty. Here, it must be taken into consideration that the slats of such vertical blinds are damaged relatively easily when pulled by hand. As a result, it has already been devised that, on the reduction gear in the drive unit housing, which is fastened to the guide rail, a plug-in socket for a mechanical operating crank is provided that is accessible from the exterior of the housing. It can easily be imagined how laborious this type of hand operation is. The result is that, when the electrical drive motor or the switch control fails, for convenience, an operator often attempts to move the blinds merely by pulling on them and they are, thus, damaged.

Of course, disengageable motor driven, endless chain drive operators are old and commonly well known. Likewise, from, for example, U.S. Pat. No. 2,029,143, it has long been known that for large Venetian blinds, such as those suitable for large department store windows, the endless chain pull element of the blind may be provided with a motor with a drive sprocket about which the hanging lower end of the chain is looped so as to enable operation of the blind at a distance via a suitably placed motor switch, while still retaining the ability to manually operate the Venetian blind.

However, vertical blinds are selected as much as an element of an attractive decorating scheme (the slats usually being made of a wide range of fabric and other decorative materials, as opposed to a typical utilitarian metal-slatted Venetian blind) as for its functional purpose in controlling natural lighting. Thus, for this reason, in addition to equally important safety considerations, it is highly undesirable to merely utilize a drive unit wherein the drive sprocket, drive motor and the like are exposed in a manner creating an unattractive appearance and potential source of injury.

SUMMARY OF THE INVENTION

In view of the foregoing, a primary object of the present invention is to configure and further develop a drive unit for vertical blinds or the like that is simple and versatile so that it can be easily retrofitted to existing blinds and, in an emergency, allows easy manual operation of the vertical blind.

A further object of the invention is to create a drive unit which, when associated with a vertical blind, will not significantly detract from its appearance or pose a safety problem.

The drive unit according to the invention achieves the objects indicated above with the features of preferred embodiments of the invention whereby the drive unit has a housing which enables the unit to be mounted onto an endless pull element of the blinds without separation and rejoining of the pull element. Furthermore, the drive motor, drive sprocket and other drive components (such as, perhaps, a reduction gear and/or transformer) are enclosed with a housing. Also, the drive controls are incorporated into the housing instead of being remotely situated.

More particularly, by placing the opening of the housing in a side wall, instead of in the front wall as in the prior art, the housing can easily be mounted on a building wall and also the pull element, in particular the pull chain, can be inserted from above into the housing, as is necessary in order to be able to attach the housing on a building wall or on the frame of an associated window or standing on the floor in front of the window, instead of on the support guide rail. In any case, the length of the pull element of manually operated vertical blinds can remain unchanged, since the housing of the drive unit, according to the invention, can be placed exactly on the downwardly hanging free end of the pull element. Since now the housing of the drive unit, with the electrical drive motor placed in it, is no longer located on the support guide rail, the switch control can easily be placed in or on the housing, so that a compact unit, i.e., an actual drive and control unit, for vertical blinds or the like results. Furthermore, this compact unit is visually unobtrusive and prevents harmful contact of the motor, sprocket, etc. with a person, pet, or a slat that has been caused to swing excessively.

The drive unit according to the invention can be retrofitted with little manipulation on existing vertical blinds or the like that are designed operated by hand, is built compactly, simply and cost-effectively, and furthermore, even after installation, still allows extremely simple hand operation of the vertical blinds. These benefits result since, in fact, no changes are required to the pull element length and arrangement, which are designed for hand operation.

BRIEF DESCRIPTION OF THE DRAWINGS

FIG. 2 is a partially exploded perspective view of a preferred embodiment of a drive unit according to the invention with a removable front wall lifted off;

FIG. 3 is an elevational view of the embodiment of FIG. 2 with the front wall removed;

DETAILED DESCRIPTION OF THE PREFERRED EMBODIMENTS

Figure 1A:
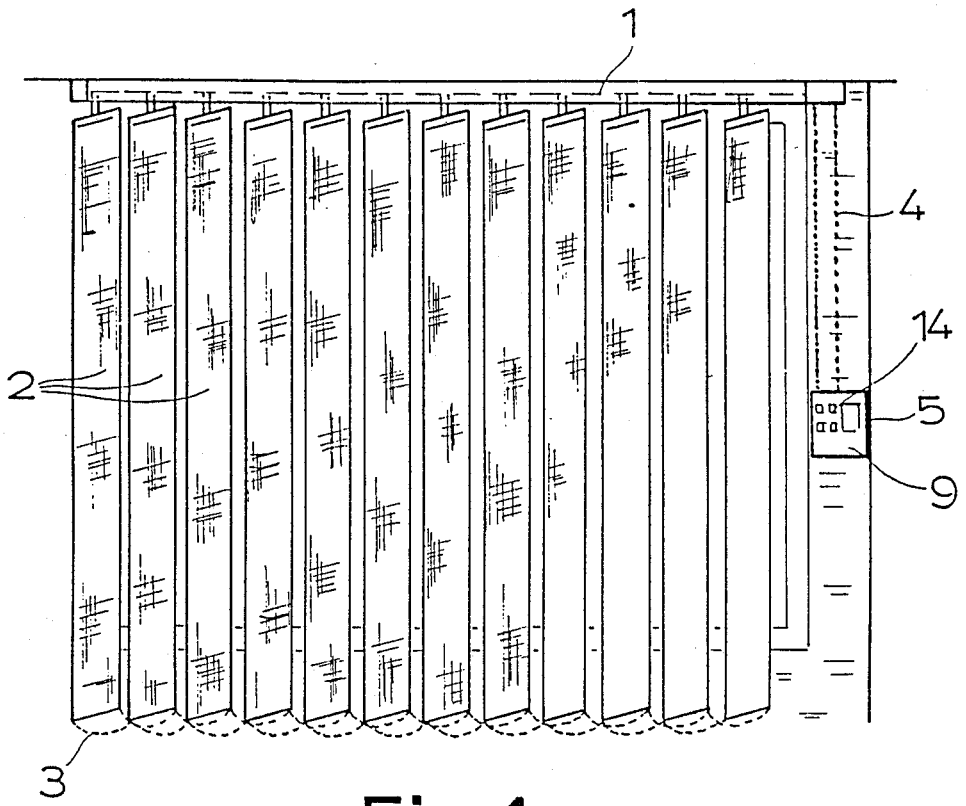
FIG. 1*a* shows a drive unit according to the invention relative to a vertical blind driven by it.

FIG. 1*a* shows a standard vertical blind construction that is provided with, for example, a support guide rail 1 mounted to the ceiling of a room and vertical slats 2 hanging down from pivoting and sliding carriers 1*a* of the support guide rail. Also shown are standard connecting chains 3, which connect slats 2 and allow both a sliding together and a pivoting of slats 2 about their vertical axes, and a pull element 4, in the form of an endless chain, that serves as the drive element for displacing and rotating of slats 2 of the vertical blinds via carriers 1*a.* Instead of a pull chain, the endless pull element 4 may be a wire rope encased in plastic, a plastic rope, etc., i.e., all standard pull elements that are intended and suitable for this type of application can be used as pull elements. Thus, except for the drive unit of the invention, the vertical blind illustrated in FIG. 1*a* is of conventional construction, greater details of which are unnecessary to an understanding of the invention.

The drive unit of the invention has a housing 5, which consists preferably of plastic, in particular a thermoplastic plastic, and receives an electrical drive motor 6. It is evident that electrical drive motor 6 will be powered by building power lines via an electrical connecting cable and/or by a battery, not shown in the drawing in detail. Drive motor 6, advantageously, may be a direct current motor of relatively low power and relatively high speed, in particular a power of 10 to 15 watts and a speed of several thousand rpm. It has been found that such motors are especially well suited for the present application since they are especially small and, in combination with a highly reduced reduction gear, still result in the required running speed for endless pull element 4. In this connection, such a drive unit having a reduction gear 7 downstream from drive motor 6, is indicated, for example, in FIG. 3. In any case, a drive pinion 8 is coupled to drive motor 6, optionally by reduction gear 7, all of these components and connections being disposed within housing 5. Drive pinion 8 is coupled to the pull chain or to another type of drive element for other pull elements, for example, a friction roller with a counterpressure roller or a grooved pulley.

Housing 5 has a front wall 9, a back wall 10, as well as top and bottom side walls 11 and end face walls 12 that connect front wall 9 to back wall 10. In the embodiment represented here, the pull element 4, in the form of an endless chain, is inserted through openings 13 into housing 5 and then is hung on drive pinion 8. Further, the control means for operation of the drive unit by a user, such as control switches 14, is provided on the housing 5.

Figure 1B:
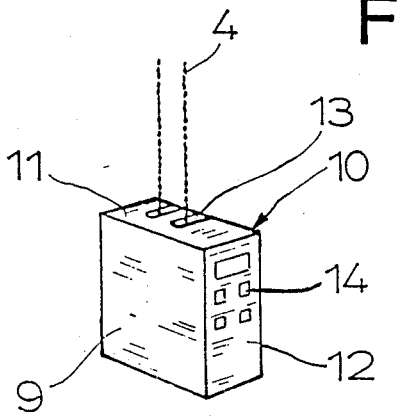
FIGS. 1*b* and 1*c* show alternative placement possibilities for the drive unit shown in FIG. 1*a;*

As shown in FIG. 1*a,* the drive unit as a whole, namely housing 5 of the drive unit, is placed by the frame of the window to be covered by slats 2, namely at a height that corresponds to the height of the closed end loop of pull chain 4, in vertical blinds that are designed to be operated by hand. This has become possible, according to the invention, by placing openings 13 in top side wall 11 and, preferably, corresponding openings 15 in the opposite, bottom, side wall 11, and by placing the control switches 14 or at least a receiving part thereof in or on housing 5. The essential resulting effect is that described in the "Summary of the Invention" part of this specification. Openings 15 in bottom side wall 11 act to supplement the range of applications for the drive unit so that the drive unit can, thus, be especially versatile. The second openings 15 make it possible that, by simply turning housing 5 180° in the plane of the rear wall 10 (i.e., about an axis extending normal to rear wall 10 so as to be inverted), housing 5 can now be fastened at its rear wall 10 with the control switches 14 located on the left side, instead of on the right side of housing 5, for use at the right side of a window or glass door being covered by the vertical slats 2. FIG. 1*b* clearly shows the housing 5 fastened with the control switches facing to the right (for mounting at the location of the housing shown in FIG. 1), and it can easily be seen how, that by turning housing 5 and inserting pull chain 4 on the other wall 11, fastening on the left side is also possible.

Figure 1C:
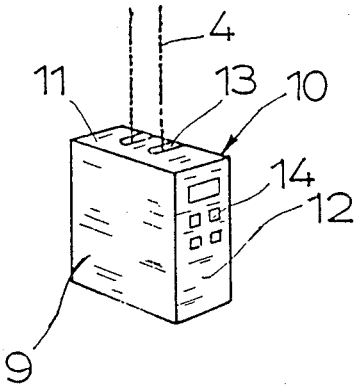

FIG. 1*c* shows a further possibility for placement of the drive unit. In particular, it may be placed on the floor by a corresponding window, i.e., with bottom side wall 11 sitting on the floor so that the housing is, otherwise, freestanding.

To be able to hang pull chain 4 easily on drive pinion 8, it is advisable that front wall 9 be removable from side walls 11 and face walls 12. This can be seen especially clearly in FIG. 2. With the possibility of being able to remove front wall 9, the insertion of pull chain 4 is especially simple if openings 13, 15 in side walls 11 of housing 5 are made as slots defined by somewhat U-shaped notches in the side walls 11 that are open toward front wall 9. This slot shape, open on one side, of openings 13, 15 can clearly be seen in the figures.

When top and bottom openings 13, 15 are provided, in actual use, one of openings 13, 15 remains unused.

For pollution engineering and optical reasons, it is then advisable that both of the openings in the housing 5 be initially closed by thin plastic films and that the required opening be able to be opened by bursting the thin plastic film. Such films are not shown in the figures, but the manner of use thereof is easily understandable to the extent that such is known, per se, for analogous applications, for example, in generally usable wall electrical outlets.

Further, FIG. 2 shows that in the embodiment shown here, each set of openings 13, 15 has two parts, namely an entrance part and an exit part. In this way an especially simple insertion of pull chain 4 into housing 5, around drive pinion 8 and, again, out of housing 5 is possible.

FIGS. 1*b* and 2 to 8 relate to embodiments of the invention for an especially common application, wherein housing 5 can be attached with back wall 10 to a building wall or the like and, for this purpose, suitable attachment elements or attaching recesses are provided. The direct attachment of housing 5 by its back wall to a building wall or the like can be done, from an attachment engineering viewpoint, in an especially practical, stable and simple way, by conventional fastening means.

FIG. 3 shows, clearly, a central bearing that forms the rotational axis of drive pinion 8. This axis forming bearing may be formed as a screw holder for attachment of front wall 9 of housing 5 via a fastening screw 18, which is attached centrally on front wall 9. While the preceding forms a stable and simple construction in the embodiment represented here, it is also possible to add a rotating latching attachment on front wall 9 that engages a frame-like attachment in side walls 11 and face walls 12.

Figure 5:
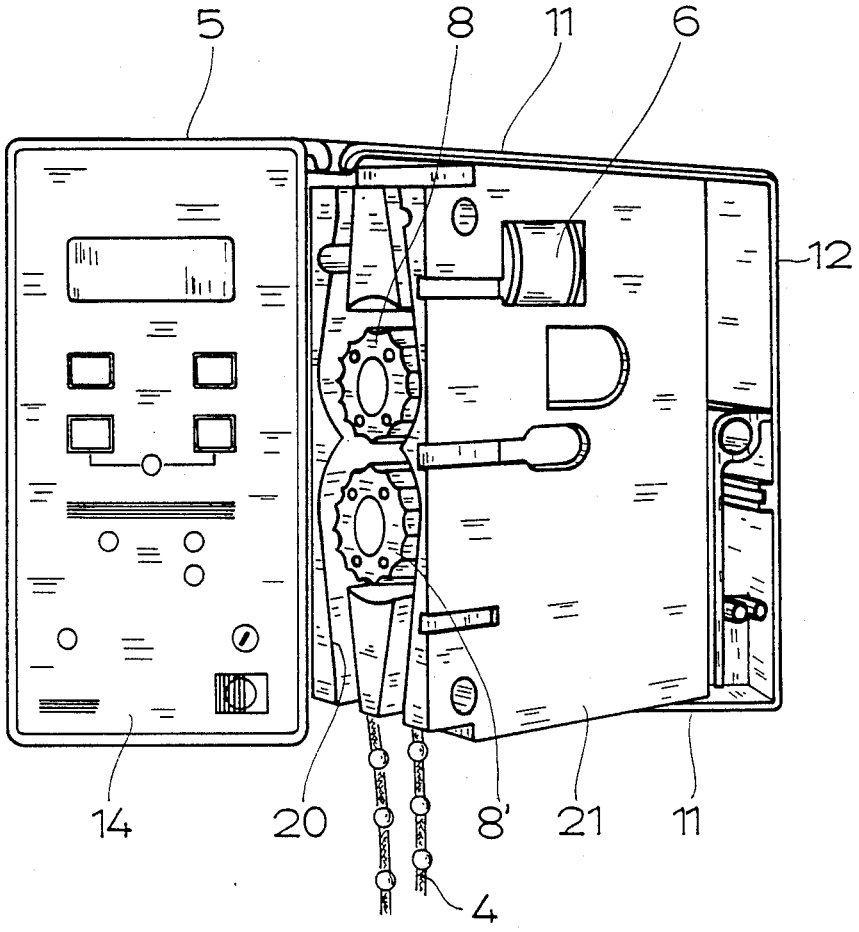
FIG. 5 shows the embodiment of FIG. 4 in perspective view with a drive support swung out.

Another embodiment of a drive unit is shown in perspective view in FIG. 5, and differs from that in FIG. 3 in that a second, preferably identical, drive pinion 8' is associated with drive pinion 8. Drive pinions 8, 8' are placed a short distance above one another so as to define a nip (i.e., a gripping region where the pinions are closest together) at which the distance between pinions 8, 8' allows passage of pull element 4 through the nips in engagement with drive pinions 8, 8' and the axial width (thickness) of drive pinions 8, 8', perpendicular to the direction of passage, is more than twice the diameter of pull element 4. Further, it can clearly be seen that guide elements 20, for precise guidance of pull element 4, are placed around drive pinions 8, 8'. Corresponding guide elements 20 are also indicated in FIG. 3 of the drawing, but are in the form of guide rollers instead of fixed surfaces.

The construction represented in FIG. 5, with two drive pinions 8, 8' placed approximately in the shape of an "8", allows a crosswise guidance of pull element 4 with repeated engagement of pull chain 4 on drive pinions 8, 8'. This guarantees a secure guidance of pull chain 4 that is especially powerful in terms of traction, as the pull element passes between the pair of drive pinions 8, 8'. Further, the guide elements 20 assure that pull element 4 does not pop off of the drive pinions 8, 8' and does not otherwise tangle up.

As FIGS. 2 and 3 show, especially clearly, that housing 5 is made of an elongated block-like shape wherein drive motor 6, optionally present reduction gear 7, and other elements 16, such as a transformer or the like, are in a plane that is parallel to front wall 9 and back wall 10. In the embodiment shown in FIG. 3, elements 16 can be two transformers and a switch unit. At the same time, FIG. 3 further shows a preferred embodiment insofar as drive pinion 8 is also in the plane of the other parts. Drive pinion 8 could also be in a laterally displaced parallel plane, but this would, possibly, unnecessarily increase the width of housing 5.

The embodiment shown in FIG. 5 shows another, especially practical alternative to the construction explained above, in that drive pinions 8, 8', drive motor 6 and reduction gear 7 are all placed in a single support 21, which may be pivotally mounted to the housing in any conventional manner such that can be swung out of housing 5. In this way, on the one hand, a plain, secure association of these parts within housing 5 results, and, on the other hand, it is especially simple to insert the pull element 4, in the form of a pull chain, into drive pinions 8, 8'. In the present case, this is promoted, especially due to the fact that drive pinions 8, 8' are in a plane that is approximately perpendicular to the plane of front wall 9 and back wall 10 in their in-use position i.e., when support 21 is swung in, so that access thereto is provided when the support is swung out. Drive pinions 8, 8' are thus located to a certain degree in the end face wall of support 21, and rotate about axes extending parallel to it and walls 9, 10.

Alternatively, support 21 could be made to be able to be completely pulled out of housing, so to speak, as a removable assembly. It is also noted that drive pinion 8 may be arranged in a plane perpendicular to the plane of front wall 9 regardless of whether or not a support 21 is provided.

According to a further feature, control switches 14 are integrated into a wall of housing 5, and preferably a face wall 12. An integration of control switches 14 into the front wall is shown in FIG. 1*a*. Such front mounting is especially practical for attachment of the drive unit on the visible side of a window frame, but has certain drawbacks relative to the dimensions of housing 5. As a result, it is especially advisable that, as shown in FIGS. 1*b*, 1*c* and 2–8, control switches 14 be integrated in a face wall 12 at the ends of the housing.

While integration of the control switches into the housing is independent of the provision of only top openings 13 or top and bottom openings 13, 15, if two sets of openings 13, 15 are provided so that the mounting orientation of housing 5 can be changed by simply turning it 180° (i.e., so as to be inverted), to being fastened on the right or on the left, it is then advisable that the wall supporting control switches 14, especially face wall 12, be removable from housing 5 and, preferably, be able to be fastened to housing 5 in two positions that are offset 180° relative to each other about an axis extending normal to the plane of the face wall 12, i.e., so as to be inverted. Due to the symmetry of face wall 12, it should be readily apparent that no special mounting means is required to obtain such a result since conventional mounting techniques, including a symmetrically disposed fastening element(s), snap-in fit, etc. will suffice. By using the correct opening 13 or 15 on the one hand, and suitable placement of face wall 12 with control switches 14 on housing 5, fastening on the right or left can easily be arranged in the simplest way. Alternatively, a template label could be provided for affixing over wall 12 when the housing 5 is to be installed in an inverted, i.e., left facing, orientation.

FIGS. 1*b* and 1*c* show a normal housing 5 in a parallelepiped shape in which top and bottom side walls 11 and face walls 12 run exactly perpendicular to front wall 9 and back wall 10. However, it can be appreciated from FIG. 1*b* that problems can arise, when operating and reading the control switches 14 on face wall 12, when housing 5 is fastened by back wall 10 to a housing wall. To eliminate this difficulty, embodiments are disclosed wherein the face wall 12 supporting control switches 14 is placed, relative to the plane of back wall 10 or front wall 9, not perpendicular, but slanted, preferably with an angle of inclination between 80° and 10°, in particular between about 30° and 60°. In the embodiment shown in FIGS. 2 and 3, the angle is 45°, but a somewhat steeper angle may possibly be more practical for optimal reading. Further, the face wall supporting the control switches can also be placed, relative to the top and bottom side walls, not at a right angle, but at an acute or obtuse angle, to enable an improved readability at an angle from above.

Figure 4:
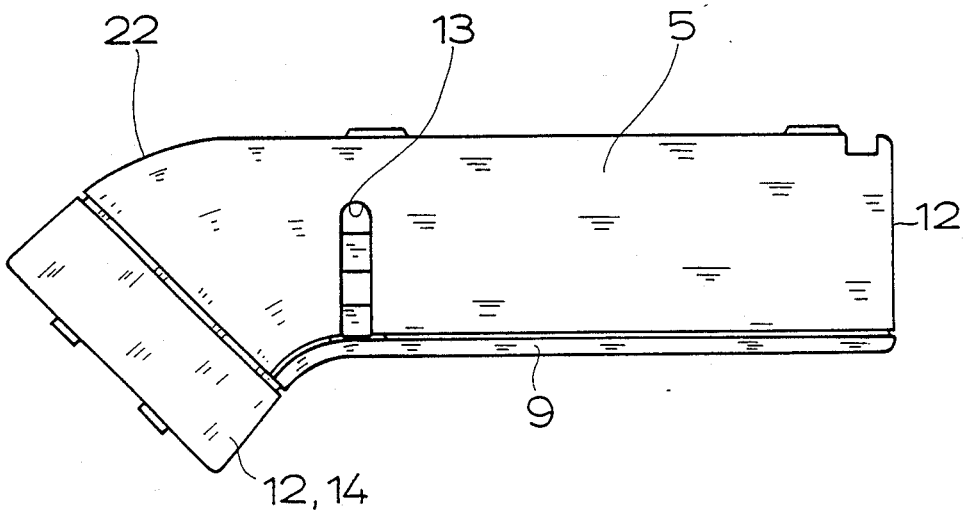
FIG. 4 is a top view of another embodiment of a drive unit in accordance with the invention.

FIG. 4 further shows an embodiment where, for aesthetic reasons, housing 5 has been given an arc-shaped transition zone 22 leading to the face wall 12 supporting control switches 14.

In the embodiment represented in FIGS. 2, 3 and 6, the angular position of face wall 12 is achieved (even though face wall 12 itself has a flat, plate shape) by side walls 11 being bevelled in the form of miter cuts on the ends adjoining the face wall 12 which supports control switches 14. In contrast, for the alternative embodiment that is represented diagrammatically in FIG. 7, the face wall 12 into which control switches 14 are integrated is provided with side wall sections 19 that are bevelled on their free ends in the form of miter cuts. Here, the ends of the side walls 11 are then provided with edges that run perpendicular to front wall 9 and back wall 10.

Figure 8A:
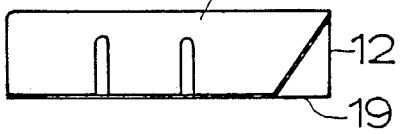
FIG. 8, *a, b, c* and *d,* is a representation, similar to FIG. 6, for another embodiment of a drive unit according to the invention.
Figure 8B:
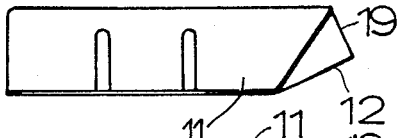
Figure 8C:
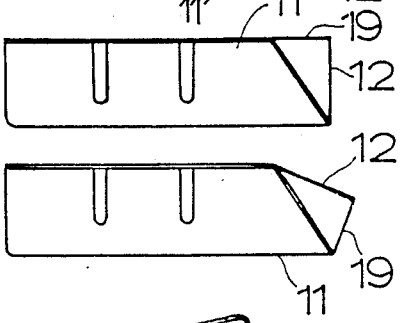

Finally, FIG. 8 shows an alternative that combines the two possibilities explained above, an alternative that is distinguished to a certain extent by the fact that here the free ends of side wall sections 9 are bevelled with a miter square that corresponds to the miter square of side walls 11.

Figure 6A:
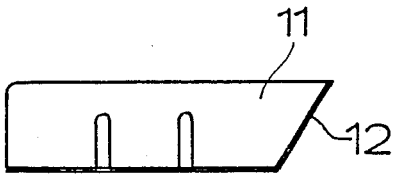
FIG. 6*a* and *b,* shows, in a top view, two possible mounting arrangements for the embodiment of FIG. 2.
Figure 6B:
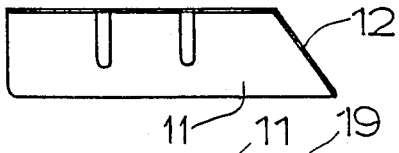
Figure 7A:
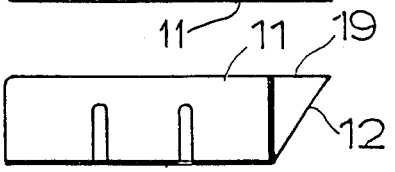
FIG. 7, *a* and *b,* is a representation, corresponding to that of FIG. 6, of a further embodiment of a drive unit according to the invention.
Figure 7B:
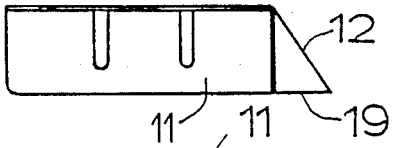

FIGS. 6*a* and 7*a* each show a housing 5 that is to be fastened on the right, while FIGS. 6*b* and 7*b* each show a housing 5 to be fastened on the left side. The FIG. 7 version illustrates that here, on the one hand, the individual parts of control switches 14 can easily be accommodated in face wall 12, which is made tub-like so to speak. On the other hand, face wall 12 can be replaced by a smooth, flat face wall according to FIG. 6, and then a housing 5 similar to FIG. 1*b* or 1*c* is the result.

FIG. 8 shows that the alternatives shown here give the optimal number of possible variations, namely without exchanging side wall 12, only by reorienting the fastening on the right, fastening on the left; angular positioning of the panel of control switches 14 and without angular positioning of the panel of control switches 14. Only the control switches 14 still must, in this case, at least be able to be rotated, with its operating elements and display elements, by 180° relative to face wall 12 itself so as to be inverted.

Figure 9:
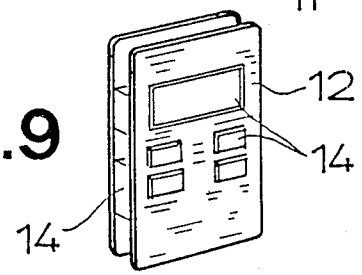
FIG. 9 shows a preferred embodiment of a switch control for a drive unit according to the invention.

FIG. 9 shows that, here, control switches 14 are made into a flat plate-like or block-like control unit 14'. The body of control unit 14' forms face wall 12 itself. The body of control unit 14' may be formed of a thin plastic cover. In FIG. 9, it can be seen that control unit 14' has an electronic switch plate that may include a timer with an operator panel with operating buttons and timer display arranged to achieve a very flat, yet electronically highly efficient arrangement that allows implementation of a long-term programming of the drive unit, a following of the sun by the slats and a multiplicity of possible special programs. Equipped with a suitably efficient microprocessor and with suitable operating buttons, such a control unit 14' can be made extremely compact. The timer display can also act for operator guidance and, for this purpose, may be made as a general alphanumerical display, as is known, itself, in pocket calculators, etc.

If control unit 14', according to FIG. 9 or in one of the geometric shapes shown in one of FIGS. 5, 7 and 8, is made as an enclosed part, it can then be practical that the control unit, preferably by removing the appropriate face wall from the housing, can be used as a remote control. For this purpose, unit 14' may be connected by an electric control line to the drive motor or, without wires, to the receiving part remaining in the housing, control being possible, e.g., by infrared means of known remote controller design. When unit 14' is removed, the missing face wall can either be replaced by a smooth face wall or the corresponding side can have an additional inner wall which shields the inside of the housing and renders it inaccessible from the outside. In any case, a full remote control of the drive unit according to the invention can thus be implemented, and simultaneously it is possible, without problems, to have an appropriate, matched storage place in the housing for the remote control unit.

It should also be appreciated that the use of the drive unit of the invention keeps the pull element 4 freely accessible for manual operation in the case of a power failure, damage to the motor or other drive component, etc. In this regard, provision should be made to prevent movement of the pinion 8 or pinions 8, 8' from being restrained by a deactivated or disabled drive motor 6. For example, a suitable clutch may be incorporated into the coupling between the drive motor and the pinion 8, or a gear of the reduction gear 7 may be spline mounted for manual displacement to a position disengaging it from the pinion 8 and/or the drive motor 6. Other known techniques will also be readily apparent to those of ordinary skill in the art, as well.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. A drive unit, for a vertical blind or the like having a plurality of slats that are movable by an endless pull element, of the type comprising a drive motor, said drive motor being coupled to a drive pinion that is constructed for drivingly engaging the pull element, and switch control means for operating the drive motor, the improvement comprising a housing enclosing said drive motor and drive pinion, and having means for enabling said drive unit to be installed onto a portion of the pull element, without separation and rejoining thereof, in each of two orientations of the housing that are offset 180° relative to each other about an axis extending normal to the plane of a rear wall of the housing so as to be inverted; wherein said means for enabling comprises a side wall at each of top and bottom sides of said housing being provided with opening means for providing access to said drive pinion and for enabling said portion of the pull element to pass into the housing to the drive pinion and to pass out of the housing therefrom, and the switch control means being integrated into a removable end face wall that is fastenable to the housing in each of two positions which are offset 180° relative to each other about an axis extending normal to the plane of the end face wall so as to be inverted.

2. A drive unit according to claim 1, wherein said opening means comprises a front wall that is removably mounted to side and end face walls of said housing.

3. A drive unit according to claim 2, wherein said opening means further comprises notch-like slots, in a side wall of the housing, which open toward said front wall.

4. A drive unit according to claim 2, wherein said side walls are a pair of oppositely facing top and bottom walls of the housing, and wherein said opening means further comprises notch-like slots, in each of said oppositely facing side walls of the housing, which open toward said front wall.

5. A drive unit according to claim 4, wherein said switch control means is mounted on said housing.

6. Drive unit according to claim 1, wherein side walls of the housing are bevelled in the form of miter cuts on the ends facing the wall into which the switch control means is integrated.

7. A drive unit according to claim 2, wherein a fastening screw is provided for the removable mounting of the front wall and wherein said drive pinion is provided with a center bearing forming its axis of rotation, said center bearing being formed as a screw holder for receiving said fastening screw.

8. A vertical blind or the like comprising a plurality of slats that are movable by an endless pull element, and a drive unit of the type comprising a drive motor, said drive motor being coupled to a first and a second drive pinion that are constructed for drivingly engaging the pull element, and switch control means for operating the drive motor, the improvement comprising a housing enclosing said drive motor and said drive pinions, and having means for enabling the pull element to enter into said housing and be hung on one of said drive pinions; wherein said drive pinions are placed one above the other at a distance which allows passage of the pull element through a nip formed between the drive pinions in engagement with both of said drive pinions, and wherein the axial width of the drive pinions, normal to the direction in which the pull element passes therebetween, is more than twice the diameter of the pull element.

9. Drive unit according to claim 8, wherein guide elements for exact guiding of the pull element are placed around the drive pinions.

10. Drive unit according to claim 1, wherein guide elements for exact guiding of the pull element are placed around the drive pinion.

11. Drive unit according to claim 1, wherein the housing is in the shape of an elongated block.

12. Drive unit according to claim 11, wherein said drive pinion is mounted for rotation in a plane that is parallel to front and back walls of the housing.

13. A drive unit, for a vertical blind or the like having a plurality of slats that are movable by an endless pull element, of the type comprising a drive motor, said drive motor being coupled to a drive pinion that is constructed for drivingly engaging the pull element, and switch control means for operating the drive motor, the improvement comprising a housing enclosing said drive motor and drive pinion, and having means for enabling said pull element to enter into said housing, and wherein the drive pinion, the drive motor, and a reduction gear are placed in a support, said support being pivotally mounted to the housing in a manner permitting it to be swung out of the housing as a means for providing access to said drive pinion and for enabling the pull element to be freely inserted onto the drive pinion.

14. Drive unit according to claim 13, wherein the drive pinion is mounted for rotation, about an axis extending parallel to front and back walls of the housing, in a plane that is approximately perpendicular to said front and back walls of the housing, and wherein said support is swingable into and out of a front side of said housing to provide access for axial insertion of the pull element onto the drive pinion.

15. Drive unit according to claim 1, wherein the wall into which the switch control means is integrated is slanted relative to at least one of back and front walls of the housing at an angle of inclination between 80° and 10°.

16. Drive unit according to claim 15, wherein said angle of inclination is approximately 30° to 60°.

17. Drive unit according to claim 15, wherein the into which the switch control means is integrated is at an end of an arc-shaped transition area of the housing.

18. Drive unit according to claim 1, wherein side walls of the housing are bevelled in the form of miter cuts on the ends facing the wall into which the switch control means is integrated and is provided with side wall sections, and wherein said side wall sections have ends that are bevelled in the form of miter cuts.

19. Drive unit according to claim 1, wherein the control means has an electronic switchplate with an operator panel having operating buttons and a display.

20. Drive unit according to claim 1, wherein the switch control means is in the form of a detachable remote control unit.

21. Drive unit according to claim 1, wherein the wall into which the switch control means is integrated is an end face wall that is provided with side wall sections that are bevelled in the form of miter cuts on ends facing side walls of the housing.

* * * * *